US012383041B2

(12) United States Patent
Lin

(10) Patent No.: US 12,383,041 B2
(45) Date of Patent: Aug. 12, 2025

(54) ELECTRIC HAIR DRYER

(71) Applicant: Shenzhen Wizevo Technology Co., Ltd., Guangdong (CN)

(72) Inventor: Yuan Lin, Guangdong (CN)

(73) Assignee: Shenzhen Wizevo Technology Co., Ltd., Guangdong (CN)

( * ) Notice: Subject to any disclaimer, the term of this patent is extended or adjusted under 35 U.S.C. 154(b) by 818 days.

(21) Appl. No.: 17/694,742

(22) Filed: Mar. 15, 2022

(65) Prior Publication Data

US 2022/0192341 A1 Jun. 23, 2022

Related U.S. Application Data

(63) Continuation of application No. PCT/CN2020/115296, filed on Sep. 15, 2020.

(30) Foreign Application Priority Data

Sep. 16, 2019 (CN) ..... 201910870953.6

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/10
See application file for complete search history.

(56) References Cited

U.S. PATENT DOCUMENTS

| | | | |
|---|---|---|---|
| 5,168,641 | A | 12/1992 | Smal |
| 2013/0111777 | A1 | 5/2013 | Jeong |

FOREIGN PATENT DOCUMENTS

| | | | | |
|---|---|---|---|---|
| CN | 207506112 | U | | 6/2018 |
| CN | 108851462 | A | | 11/2018 |
| CN | 109512119 | A | | 3/2019 |
| CN | 110150827 | A | | 8/2019 |
| CN | 209185835 | U | | 8/2019 |
| CN | 110477573 | A | | 11/2019 |
| EP | 0451127 | A2 | | 10/1991 |
| GB | 2521145 | A | | 6/2015 |
| RU | 2206792 | C2 | * | 6/2003 |
| WO | 2018205451 | A1 | | 11/2018 |

OTHER PUBLICATIONS

Translation RU-2206792-C2 (Year: 2003).*
International Search Report for PCT/CN2020/115296 dated Dec. 15, 2020, (6 pages).
"Dismantler's Paradise", https://www.mydigit.cn/forum.php?mod=viewthread&tid=9024&mobile=2, Feb. 17, 2019.

* cited by examiner

*Primary Examiner* — Jessica Yuen

(74) *Attorney, Agent, or Firm* — Cooper Legal Group, LLC

(57) ABSTRACT

The present application provides an electric hair dryer, which includes a housing, a wind energy generator, a drive control device and a heating device. An elongated channel is formed inside the housing, an air inlet is formed in the housing at one end of the channel, an air outlet is formed on the other end of the channel, the wind energy generator and the heating device are disposed in the channel, and the heating device is used for heating the air flow in the channel; the drive control device is electrically connected to the wind energy generator and the heating device.

12 Claims, 6 Drawing Sheets

ELECTRIC HAIR DRYER

CROSS-REFERENCE TO RELATED APPLICATION

This application is a continuation of PCT application serial no. PCT/CN2020/115296, filed on Sep. 15, 2020, which claims the priority and benefit of Chinese patent application serial no. 201910870953.6, filed on Sep. 16, 2019. The entirety of PCT application serial no. PCT/CN2020/115296 and Chinese patent application serial no. 201910870953.6 are hereby incorporated by reference herein and made a part of this specification.

TECHNICAL FIELD

The present application relates to a field of hair drying device and in particular, relates to an electric hair dryer.

BACKGROUND ART

An electric hair dryer is a commonly used household appliance, mainly used for hair drying and shaping. In addition, it can also be used for local drying, heating and physiotherapy in a laboratory, a physiotherapy room, industrial production, art designing and others, having a wide application.

At present, there are various styles of the electric hair dryer on the market, which mostly includes the handle portion and the main body. The handle portion and the main body of the electric hair dryer are mostly integrated with each other. The handle can also be designed to be bendable for storage. However, the whole structure is still not compact enough.

SUMMARY

The present application provides an electric hair dryer, in which individual function modules are integrated in a cylindrical housing, providing the advantages of compactness and portability.

The present application is realized by adopting the following technical solution.

An electric hair dryer includes a housing, a wind energy generator, a drive control device and a heating device, an elongated channel is formed inside the housing, an air inlet is formed in the housing at one end of the channel, an air outlet is formed on the other end of the channel, the wind energy generator and the heating device are disposed in the channel, and the heating device is used for heating the air flow in the channel; the drive control device is electrically connected to the wind energy generator and the heating device. In some embodiments, a diversion structure for guiding the heated air flow to the air outlet is provided at the connection position of the housing with the air outlet. The heating device provides heat for the air generated by the wind energy generator. In some embodiments, the housing includes a first housing body and a second housing body, the first housing body and the second housing body together define an elongated channel. In some embodiments, the air inlet is disposed in axial direction with respect to the channel. In some embodiments, the air inlet is disposed in radial direction with respect to the channel. In some embodiments, the air outlet is disposed in radial direction with respect to the channel.

With the above technical solution, the air inlet and the air outlet of the electric hair dryer are both provided in the housing, and are perpendicular to each other. The drive control device, the wind energy generator, the heating device and the diversion structure are all disposed inside the housing. The first housing body and the second housing body form the first mounting chamber, the second mounting chamber and the third mounting chamber in a line. That is, the housing of the electric hair dryer is in a continuous cylindrical shape. The air outlet is disposed on a radial sidewall of one end. The air flow can act directly on the human hair.

Further, a shock-absorbing sleeve is provided inside the channel of the housing. An annular groove for accommodating the wind energy generator is provided in an inner ring of the shock-absorbing sleeve. In some embodiments, the shock-absorbing sleeve is made of elastic material. In some embodiments, a wire groove is provided in the outer wall of the shock-absorbing sleeve along the axial direction.

With the above technical solution, the shock-absorbing sleeve is disposed between the housing and the wind energy generator, which makes up the gap therebetween. In addition, by using the elastic of the shock-absorbing sleeve, a reacting force is generated to against the vibration force generated by the wind energy generator, which can counteract the majority of the vibration force, so that user feels a softer micro vibration when the hand holds the handle, which improves the comfort degree of the handle.

Further, a rib assembly for accommodating the shock-absorbing sleeve is provided inside the channel of the housing; and the rib assembly is distributed along circumference and forms a groove gap extending along the axial direction. A protruding portion of the wire groove is inserted in the groove gap to form a stopper in the circumferential direction.

With the above technical solution, the rib assembly can provide a mounting area for accommodating the shock-absorbing sleeve. The groove gap and the protruding portion of the wire groove forms an insertion stopper, which makes the shock-absorbing sleeve more stable after fixing.

Further, the protruding portions on two edges of the wire groove each include an arc plate protruding to the outside along the radial direction. Two arc plates are wrapped around the groove edge of the wire groove in a semi-closed way. The wire groove is used for the penetration of the conductive wire, and the wire groove can be closed when bearing external pressure.

With the above technical solution, two arc plates of the wire groove facilitate hiding the wire after the conductive wire penetration. The conductive wire is temporarily restrained in the wire groove, which avoids the interference during mounting.

Further, the wind energy generator includes a micro motor and a wind blade driven by the micro motor, a sleeve ring is provided outside the micro motor. The wind blade is mounted on the main shaft of the micro motor. The sleeve ring is mounted outside the motor and extends to an outer ring of the wind blade. The blade outer ring of the wind blade is in a clearance fit with the inner wall of the sleeve ring. The sleeve ring of the wind energy generator is inserted in the annular ring of the shock-absorbing sleeve.

With the above technical solution, the mounting structure of the micro motor and the wind blade form an integrated structure after optimization, which is hidden inside the sleeve ring. The main body is inserted in the annular groove of the shock-absorbing sleeve through sleeve ring.

Further, the rib assembly includes two first arc ribs disposed separately and two second arc ribs positioned between two first arc ribs; and an annular clamping groove is provided on the outer edge of one end of the shock-absorbing sleeve. The groove depth of the annular clamping groove is adapted to the first arc rib. One end of the shock-absorbing sleeve is inserted in one first arc rib, and the other end abuts against on the end surface of the other first arc rib.

With the above technical solution, one end of the shock-absorbing sleeve is inserted in one first arc rib through the annular clamping groove, and the other end abuts against on the end surface of the other first arc rib, so as to form an insertion stopper.

Further, the heating device is positioned at the rear of the air output of the wind energy generator. In this area, a heat insulation cover is provided inside the housing; the diversion structure is disposed on the heat insulation flamen retardant cover. The heat insulation cover includes a first cover body and a second cover body, which are separated from each other. An annular recess is provided on one side of the heat insulation cover at the wind energy generator. When mounting the first cover body and the second cover body, the first cover body and the second cover body are inserted in the first arc rib through the annular recess; an inner flanging is provided on one side of the end surface of the shock-absorbing sleeve abutting to the first arc rib. The first arc rib and the inner flanging abut against in the annular recess, and a hook portion formed by one groove sidewall of the annular recess is inserted in the inner flanging of the shock-absorbing sleeve to realize a sealing connection.

With the above technical solution, a heat insulation cover is provided at the rear of the wind energy generator. The heat insulation cover is hermetically sleeved on the wind energy generator, so as to ensure a full use of the wind energy generated by the win energy generator.

Further, the heating device includes a bearing plate enclosing a rectangular frame, a supporting frame positioned inside the rectangular frame and a heating wire provided in the supporting frame. The supporting frame includes supporting plates crossly overlapped with each other and a warm air channel formed by the distance between the supporting plates. A plurality of grooves are provided in an outer ring of the supporting plate. The coiled heating wire is inserted in the groove and is positioned in the warm wind channel. A positive terminal and a negative terminal are provided in the supporting frame, which are corresponding to two ends of the heating wire respectively. The terminal is electrically connected to the drive control device through conductive wire, and a fuse is added in a connection section of one terminal.

With the above technical solution, by using the detachable bearing plate and the supporting plate, it is convenient to change and repair the fuse.

Further, the heat insulation cover includes a first cover body and a second cover body, which are separately disposed; and the diversion structure includes a diversion opening disposed on the first cover body, which is communicated with the air outlet. The diversion opening is adapted to the air outlet. A plurality of the diversion plates are provided in the inner wall of the diversion opening along the circumferential direction. The diversion plates extend along the radial direction and are in an equidistant distribution along circumferential direction. A vacancy position is provided on a tail end of the diversion opening. A protrusion protruding as a cylindrical shape is provided in the second cover body. The edges of the protrusion and the second cover body are in an arc transition, and the edges form a flow path. A splitter plate is provided in the second cover body at the position corresponding to the vacancy position of first cover body. The splitter plate divides the flow path of the second cover body into two independent portions. A bottom of the splitter plate in the flow path of the second cover body extends to the vacancy position of the first cover body.

With the above technical solution, the diversion structure diverts the air out appropriately by the structure thereof.

Further, the first cover body is gradually shrunk in the direction from the heating device to the diversion opening, so that the space of the flow path formed by the first cover body and the second cover body is slumped.

With the above technical solution, the air flow generated by the wind energy generator flows through the heating device and collects in the flow path. The air flow generated by the wind energy generator enters the flow path through the heater, and the diversion plates in the flow path stop the air flow. During stopping, the air pressure is increased and two short and powerful air flows are formed, and divert evenly out through the splitter plates in the diversion direction of the diversion plate.

DETAILED DESCRIPTION

The present application will be further described in detail below in combination with figures.

First Embodiment

Figure 1:
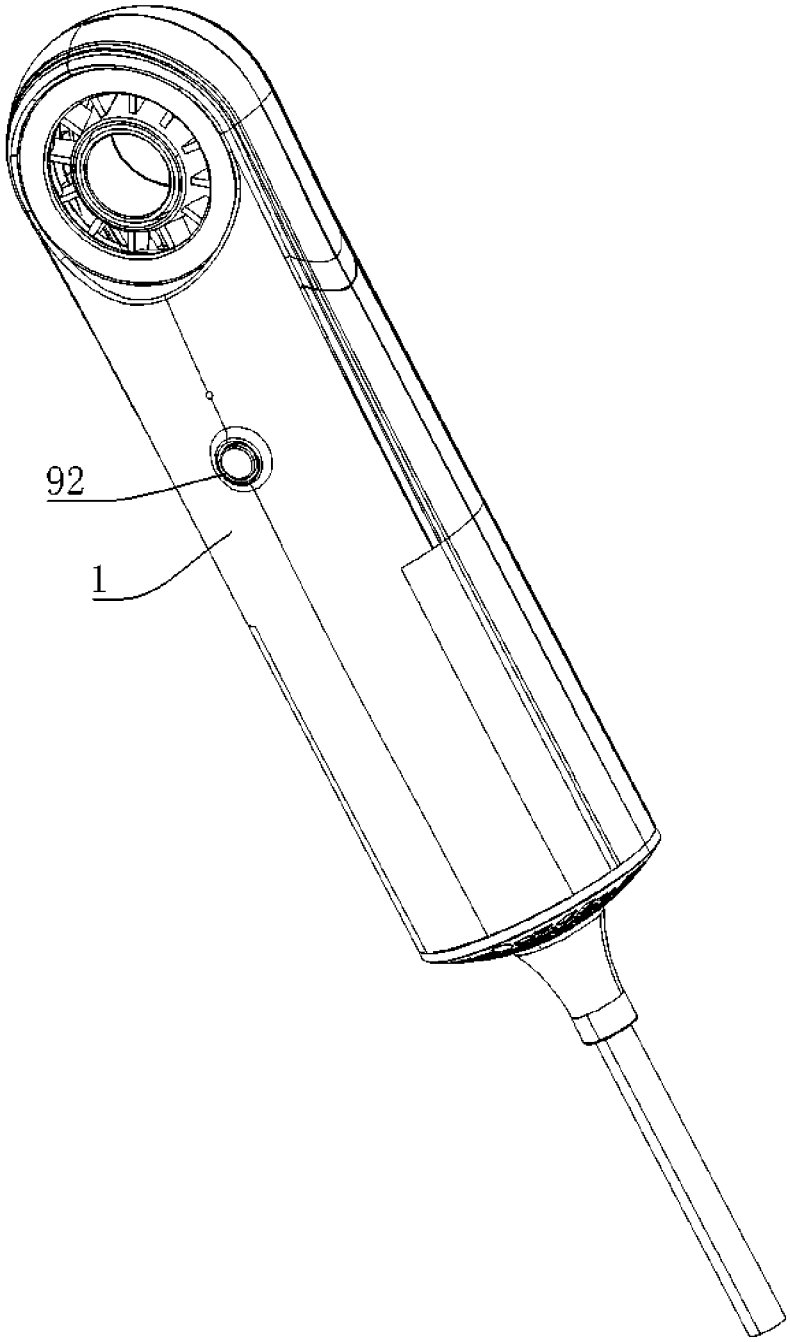
FIG. 1 is a structural schematic diagram of a housing of an electric hair dryer according to an embodiment.
Figure 2:
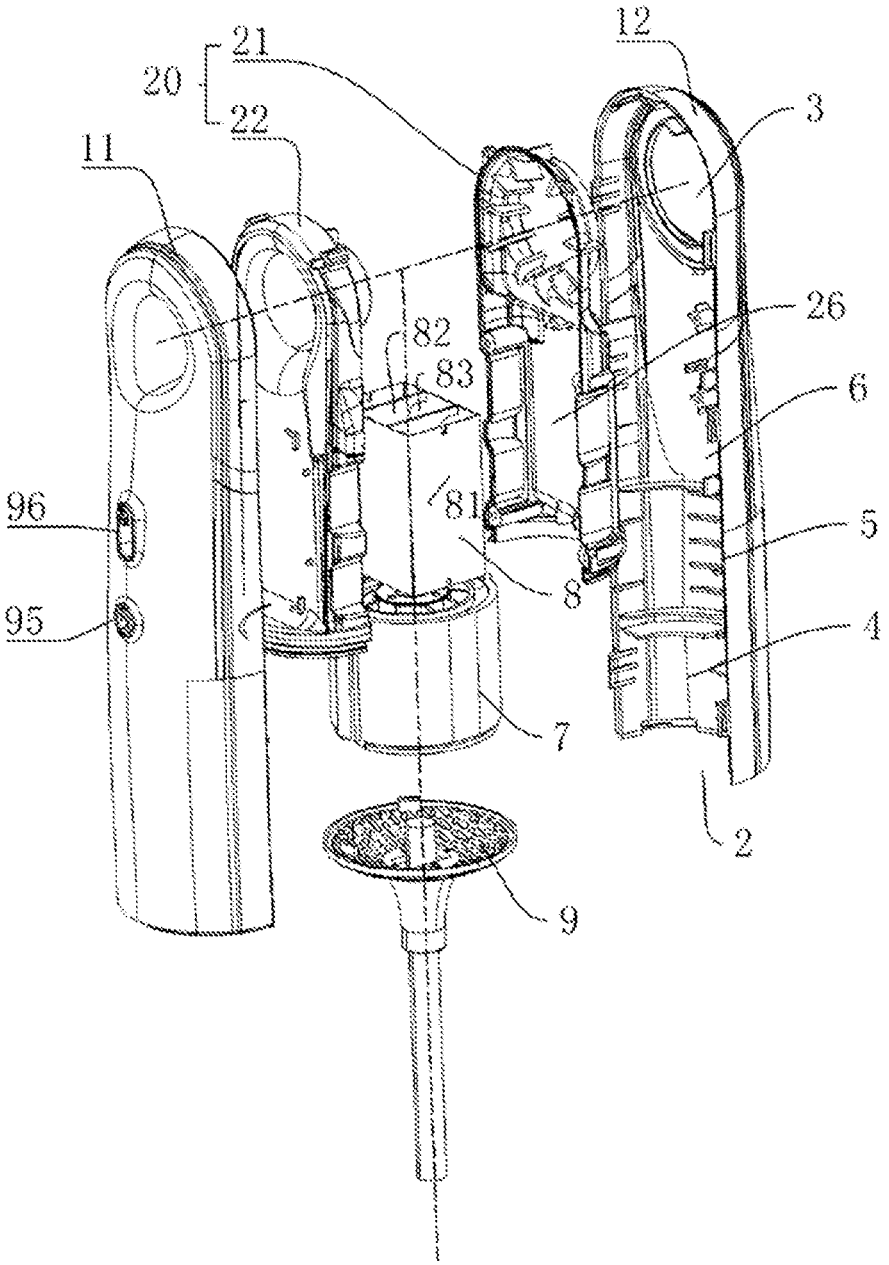
FIG. 2 is a schematic diagram of the explosion structure of an electric hair dryer according to an embodiment.

Referring to FIG. 1 and FIG. 2, an electric hair dryer includes a housing 1. In some embodiment, the housing 1 is an integrated housing and an elongated channel such as is formed therein, such as cylindrical, rectangular, or similarly shaped channel. In some embodiments, the housing 1 includes a first housing body 11 and a second housing body 12. In some embodiments, the first housing body 11 is in snap connection with the second housing body 12. The first housing body 11 and the second housing body 12 form an elongated channel, such as a cylindrical channel. An air inlet 2 is formed in the housing 1 at one end of the channel. In some embodiments, the air inlet 2 is disposed in axial direction with respect to the channel, as shown in FIG. 2. In some embodiments, the air inlet 2 is disposed in radial direction with respect to the channel, for example, disposed in the sidewall of the housing 1. A cover plate 9 with a plurality holes is mounted at the air inlet 2. The cover plate 9 can close the air inlet 2 and the air flow can penetrate through the holes of the cover plate 9.

An air outlet 3 disposed in radial direction is formed on the other end of the housing 1. The air outlet 3 is positioned in the first housing body 11 and is communicated with the channel. In this embodiment, the orientation of the air outlet 3 and the orientation of the air inlet 2 are perpendicular to each other. Accordingly, a diversion structure 23 for guiding the air flow to the air outlet 3 is also provided in the channel.

The electric hair dryer in this embodiment also includes a wind energy generator 7, a driving control device and a heating device 8. In particular, the wind energy generator 7 and the heating device 8 are disposed in the channel, in which the wind energy generator 7 is used to generate air flow in the channel, and the heating device 8 is used to heat the air flow in the channel to obtain warm air. In addition, the driving control device, the wind energy generator 7 and the heating device 8 are electrically connected through a conductive wire. Accordingly, the second housing body 12 can be provided with a power switch for controlling the opening and closing of the wind energy generator 7 and an air volume adjusting switch for controlling the air volume of the wind energy generator 7. The power switch and the air volume gear switch are electrically connected with the driving control device.

In addition, the drive control device can be mounted in the channel or on the housing. In this embodiment, the drive control device is mounted in the channel, so that the overall structure of the electric hair dryer is simple and compact.

A first mounting chamber 4, a second mounting chamber 5 and a third mounting chamber 6 can be provided in the housing 1 from the air inlet 2 to the air outlet 3 successively. The distribution sequence of the wind energy generator 7, heating device 8 and the drive control device is not limited. In some embodiments, the drive control device is mounted in the first mounting chamber 4 (not shown in the figure). The wind energy generator 7 is mounted in the second mounting chamber. A heating device 8 for providing heat for the wind energy generator 7 is mounted in the third mounting chamber. The drive control device is electrically connected to the wind energy generator 7 and the heating device 8 through a conductive wire. In some embodiments, the wind energy generator 7 can be mounted in the first mounting chamber 4, the wind energy generator 7 is mounted in the second mounting chamber 5 and the heating device 8 is mounted in the third mounting chamber 6.

A plurality of threaded columns are provided in the first housing body 11 of the first mounting chamber 4. The drive control device is fixed on the threaded column in the first mounting chamber 4 via a fastener.

Figure 3:
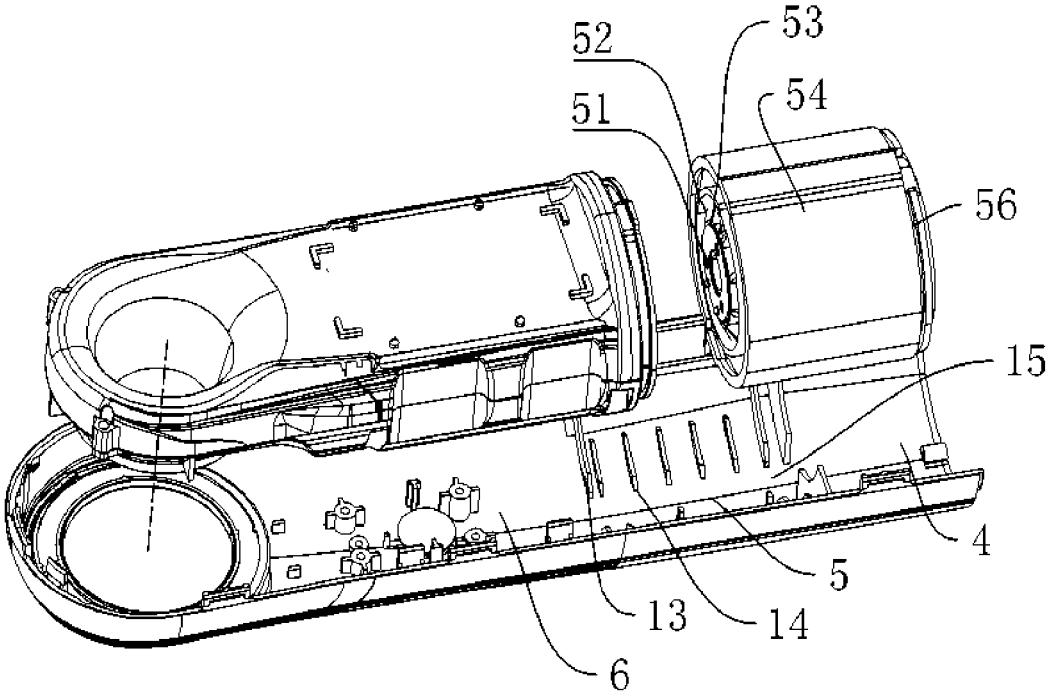
FIG. 3 is a schematic diagram of the connection relationship between a wind energy generator and a housing according to an embodiment.

Referring to FIG. 3, inside the second mounting chamber 5, the first housing body 11 and the second housing body 12 are each provided with a rib assembly disposed along the circumferential direction. In particular, the rib assembly includes two first arc rib 13 disposed separately and two second arc ribs 14 positioned between two first arc ribs 13. In some embodiments, the first arc ribs 13 are positioned at the front and rear sides of the second mounting chamber 5 along axial direction respectively. A plurality of the second arc ribs 14 are positioned at intervals between the first arc ribs 13 at the front and the rear sides respectively. The inner arc surfaces of the first arc ribs in the first housing body 11 and the second housing body 12 form a concentric circle along the circumferential direction. The inner arc surfaces of the second arc ribs also form a concentric circle along the circumferential direction. The concentric circle formed by the second arc ribs 14 has a smaller diameter than the concentric circle formed by the first arc ribs 13. The wind energy generator 7 is inserted in the area formed by the first arc rib 13 and the second arc rib 14.

In particular, the wind energy generator 7 includes a micro motor 51 and a wind blade 52 driven by the micro motor 51. A sleeve ring 53 is provided outside the micro motor 51. The wind blade 52 is mounted on the main shaft of the micro motor 51. The sleeve ring 53 is mounted at the outside of the motor and extends to an outer ring of the wind blade 52. The blade outer ring of the wind blade 52 is in a clearance fit with the inner wall of the sleeve ring 53.

Figure 4:
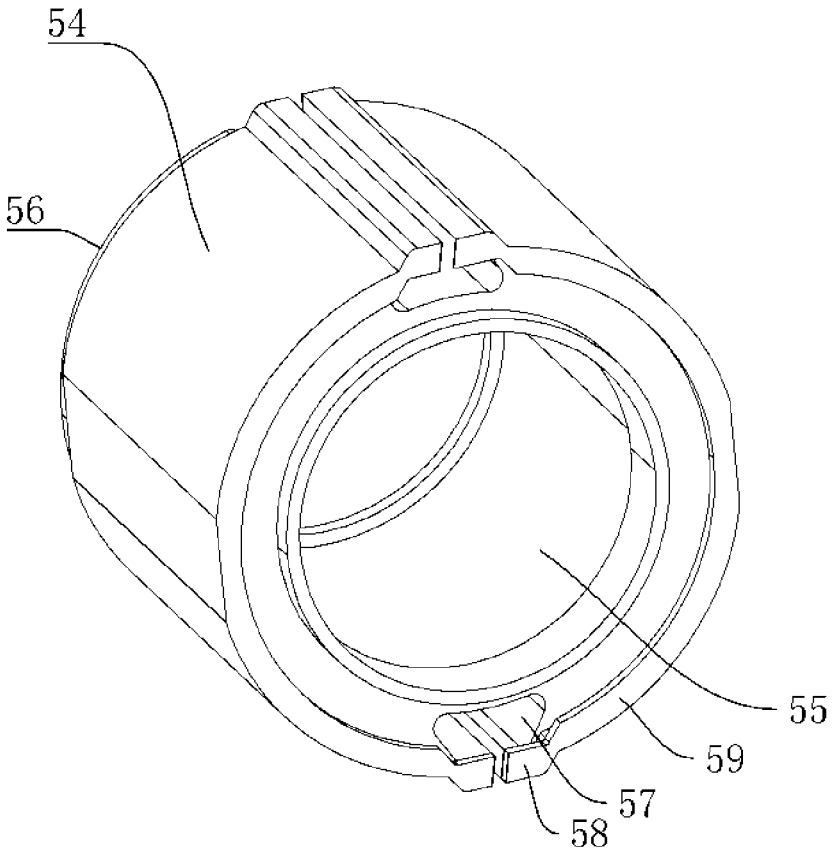
FIG. 4 is a structural schematic diagram of a shock-absorbing sleeve according to an embodiment.

Referring to FIG. 3 and FIG. 4, a shock-absorbing sleeve 54 made of elastic material is provided between the sleeve ring 53 and the housing 1. In particular, the shock-absorbing sleeve 54 can be made of rubber or silica gel, and has a certain thickness to ensure a sufficient damping effect. The micro motor 51 is sleeved and mounted in the shock-absorbing sleeve 54. An annular groove 55 for accommodating the sleeve ring 53 is provided in an inner ring of the shock-absorbing sleeve 54. The shock-absorbing sleeve 54 has a certain elasticity. The micro motor 51 is inserted and wrapped in the annular groove 55. An annular clamping groove 56 is provided on the outer edge of one end of the shock-absorbing sleeve 54. The groove depth of the annular clamping groove 56 is adapted to the first arc rib 13. When the first arc rib 13 is inserted in the annular clamping groove 56 of the shock-absorbing sleeve 54, the outer wall abuts against the second arc rib 14, and the end of the shock-absorbing sleeve 54 away from the annular clamping groove 56 abuts against the sidewall of the other first arc rib, so that the shock-absorbing sleeve 54 is confined in the area formed by the first arc rib 13 and the second arc rib 14.

The first arc rib 13 and the second arc rib 14 are distributed along circumference of the housing 1 and forms a groove gap 15 extending along the axial direction on the inner walls of the first housing body 11 and the second housing body 12. A wire groove 57 is provided in the outer wall of the shock-absorbing sleeve 54 along the axial direction. Two edges of the wire groove 57 each provides with an arc plate 58 protruding outwardly along the radial direction. Two arc plates 58 are wrapped around the groove edge of the wire groove 57, and are disposed as semi-closed. The wire groove is used for the penetration of the conductive wire. The wire groove 57 can be closed when two arc plates 58 are pressed. The protrusion portions of two arc plates are inserted in the groove gap 15 of the first housing body 11 or the second housing body 12, so as to form a limit in the circumferential direction.

Figure 5:
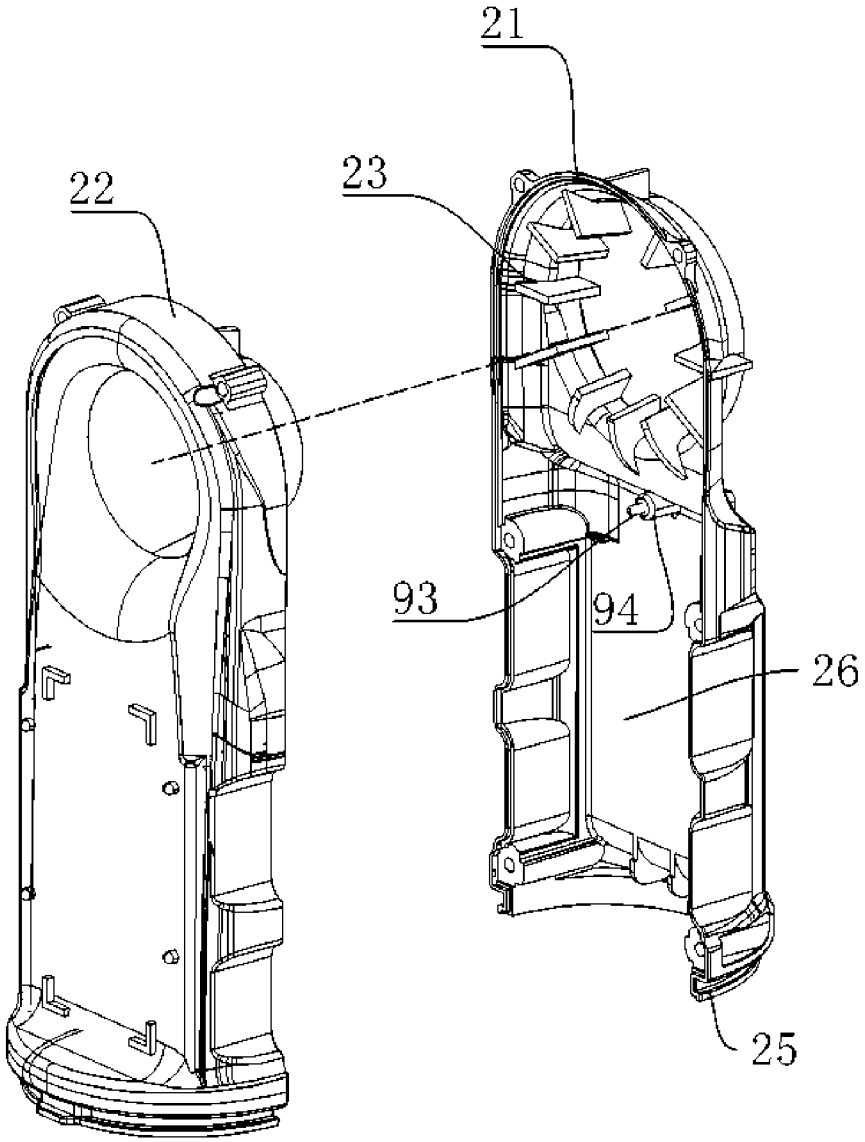
FIG. 5 is a structural schematic diagram of a heat insulation cover according to an embodiment.
Figure 6:
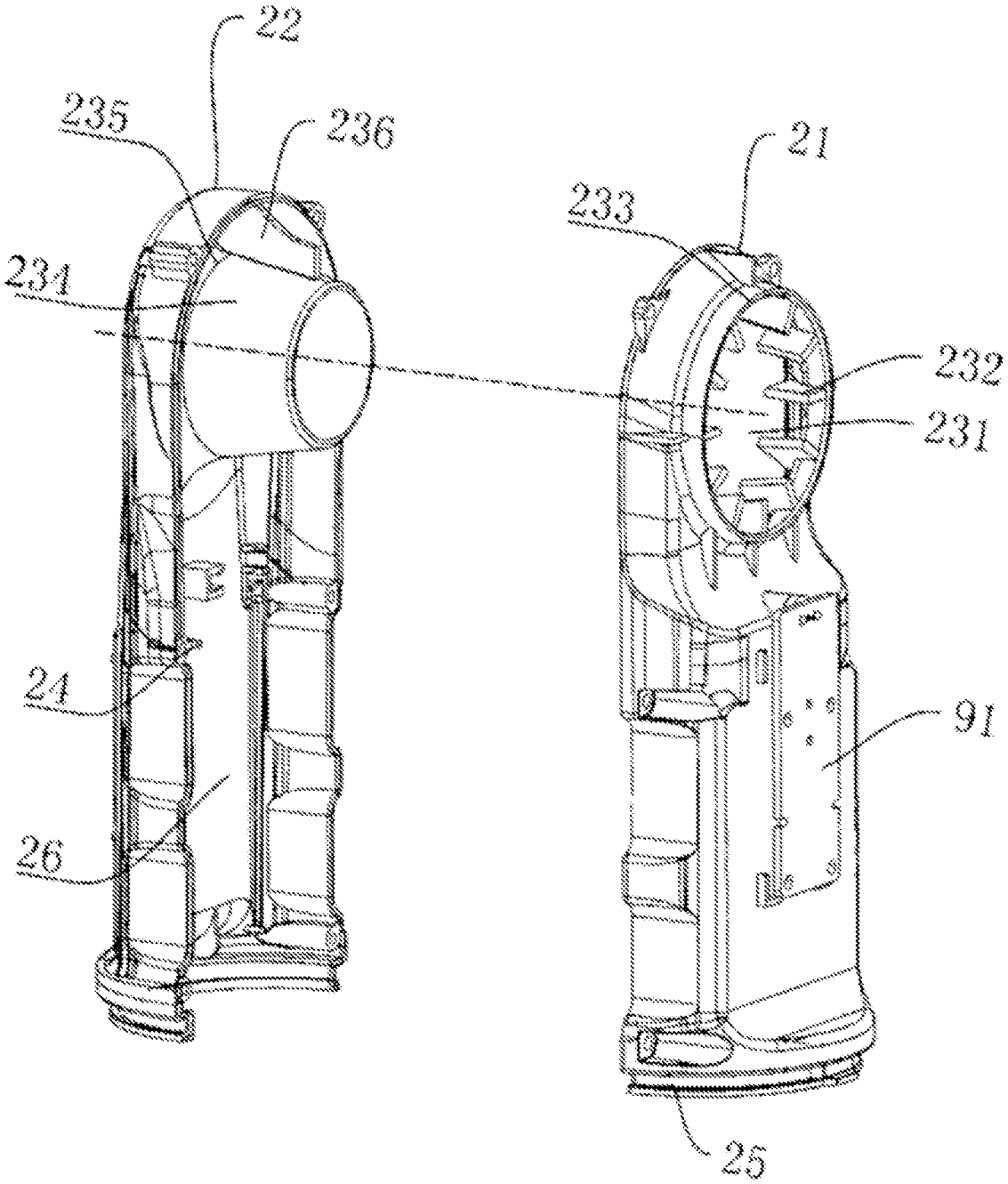
FIG. 6 is a structural schematic diagram of a temperature control module according to an embodiment.

Referring to FIG. 2, FIG. 5 and FIG. 6, the heating device is positioned at the rear of the air output of the wind energy generator 7. In this area, a heat insulation cover 20 is provided inside the housing 1. The heat insulation cover 20 is made of a blend of PA and glass fiber.

The heat insulation cover 20 includes a first cover body 21 and a second cover body 22. The first cover body 21 is fixed with the second cover body 22 through the threaded column and the screw. The first cover body 21 is inserted in the first housing body 11. The heat insulation cover 20 includes a fourth mounting chamber 26 for accommodating the heating device 8 and a diversion structure 23 for guiding the heated air flow to the air outlet 3. A stopping block 24 is provided on the boundary of the fourth mounting chamber 26 and the diversion structure 23. The heating device 8 is limited in the fourth mounting chamber 26, which avoids the displacement of the heating device 8 towards the air outlet 3.

An annular recess 25 is provided on one side of the heat insulation cover 20 at the wind energy generator. When mounting the first cover body 21 and the second cover body 22, the first cover body 21 and the second cover body 22 are inserted in the first arc rib 13 through the annular recess 25. An inner flanging 59 is provided on one side of the end surface of the shock-absorbing sleeve 54 abutting against the first arc rib 13. The first arc rib 13 and the inner flanging 59 abut against in the annular recess 25, and a hook portion formed by one groove sidewall of the annular recess 25 is inserted in the inner flanging 59 of the shock-absorbing sleeve 54 to realize a sealing connection, so as to prevent the air flow sent into the wind energy generator 7 from lateral leakage.

Referring to FIG. 2, the heating device 8 includes a bearing plate 81 forming a rectangular frame, a supporting frame positioned inside the rectangular frame and a heating wire provided in the supporting frame. The supporting frame includes supporting plates 82 crossly overlapped with each other and a warm air channel formed by the gap between the supporting plates 82. A plurality of grooves 83 are provided in an outer ring of the supporting plate 82. The coiled heating wire is inserted in the groove 83 and is positioned in the warm wind channel A positive terminal and a negative terminal are provided in the supporting frame, which are corresponding to two ends of the heating wire respectively. The terminal is electrically connected to the drive control device through conductive wire, and a fuse is added in a connection section of one terminal (the portion being shielded is not shown).

The bearing plate 81 and the supporting plate 82 are both made of connected mica sheets, which have the functions of insulation and thermal resistance achieving low loss.

The bearing plate 81 includes four main portions capable of being independently bended. After bending to form a rectangular frame, it is attached to the outside of the supporting frame and bonded with high-temperature resistant tape. In order to ensure safety, a layer of asbestos net is provided between the rectangular frame and the heat insulation cover 20 for flame retardant protection. In addition, the asbestos net can disperse the heat on the bearing plate 81 to achieve the effect of heat dissipation.

Referring to FIG. 5 and FIG. 6, a temperature control module is provided inside the first housing body 11. The temperature control module includes a circuit board 91, and a temperature control switch 92 electrically connected to the circuit board 91 for controlling the opening and closing of the heating device 8. The circuit board 91 is electrically connected to the drive control device. The circuit board 91 is positioned between the first housing body 11 and the first cover body 21. The circuit board 91 is mounted on the first housing body 11 through screw. A sensor 93 is provided on the circuit board 91. The sensor 93 can be a temperature sensor or a humidity/temperature sensor. A penetrating through hole 94 is provided at the position of the first cover body 21 close to the air inlet 2. The sensor 93 extends out of the through hole 94 to detect the temperature and/or humidity at the air outlet 3.

A power switch 95 for controlling the opening of the wind energy generator 7 is provided in the second housing body 12, and an air volume adjusting switch 96 for controlling the rotating speed of the wind energy generator 7 is also included. The power source is electrically connected to the air volume adjusting switch 96 and the drive control device.

The diversion structure 23 for guiding the air flow to the air outlet 3 includes a diversion opening 231 disposed on the first cover body 21 and communicated with the air outlet 3. The diversion opening 231 is adjacent to the air outlet 3. A plurality of the diversion plates 232 are provided in the inner wall of the diversion opening 231 along the circumferential direction. The diversion plates 232 extend along the radial direction and are in an equidistant distribution along circumferential direction. A vacancy position 233 without the diversion plate 232 is provided at a tail end of the diversion opening 231.

A cylindrical protrusion 234 is provided in the second cover body 22. The edges of the protrusion 234 and the second cover body 22 are in an arc transition, and the edges form a flow path 235. A splitter plate 236 is provided in the second cover body 22 at the position corresponding to the vacancy position 233 of first cover body 21. The splitter plate 236 divides the flow path 235 of the second cover body 22 into two independent portions. A bottom of the splitter plate 236 in the flow path 235 of the second cover body 22 extends to the vacancy position 233 of the first cover body 21. The first cover body 21 is gradually shrunk in the direction from the heating device 8 to the diversion opening 231, so that the space of the flow path 235 formed by the first cover body 21 and the second cover body 22 is greatly reduced. The air flow generated by the wind energy generator 7 flows through the heating device 8 and collects in the flow path 235. The air flow generated by the wind energy generator 7 enters the flow path 235 through the heater, and the diversion plates 232 in the flow path 235 block the air flow, by which the air pressure is increased and two short and powerful air flows are formed and evenly guided out via the splitter plates 236 in the diversion direction of the diversion plate 232.

The above are the preferred embodiments of the present application, which are not intend to limit the protection scope of the present application. Therefore, all equivalent changes made according to the structure, shape and principle of the present application should be covered within the protection scope of the present application.

What is claimed is:

1. An electric hair dryer, comprising a housing, a wind energy generator, a drive control device, and a heating device, wherein an elongated channel is formed inside the housing, an air inlet is formed in the housing at one end of the elongated channel, and an air outlet is formed on the other end of the elongated channel; the wind energy generator and the heating device are disposed in the elongated channel, and the heating device is used for heating air flow in the elongated channel; and the drive control device is electrically connected to the wind energy generator and the heating device, wherein a diversion structure for guiding the heated air flow to the air outlet is provided at a connection position of the housing with the air outlet, wherein a shock-absorbing sleeve is provided inside the elongated channel of the housing; and an annular groove for accommodating the wind energy generator is provided in an inner ring of the shock-absorbing sleeve, wherein a wire groove is provided in an outer wall of the shock-absorbing sleeve along an axial direction, and wherein a rib assembly for accommodating the shock-absorbing sleeve is provided inside the elongated channel of the housing; the rib assembly is positioned circumferentially and forms a groove gap extending along the axial direction; and a protruding portion of the wire groove is inserted in the groove gap to form a stopper in a circumferential direction.

2. The electric hair dryer according to claim 1, wherein the housing comprises a first housing body and a second housing body, and the first housing body and the second housing body together define the elongated channel.

3. The electric hair dryer according to claim 1, wherein the air inlet is disposed in the axial direction with respect to the elongated channel.

4. The electric hair dryer according to claim 1, wherein the air inlet is disposed in a radial direction with respect to the elongated channel.

5. The electric hair dryer according to claim 1, wherein the shock-absorbing sleeve is made of elastic material.

6. The electric hair dryer according to claim 1, wherein the protruding portions on two edges of the wire groove each comprises an arc plate protruding outwardly along a radial direction; and two arc plates are wrapped around the two edges of the wire groove in a semi-closed way.

7. The electric hair dryer according to claim 1, wherein the wind energy generator comprises a micro motor and a wind blade driven by the micro motor, a sleeve ring is provided out of the micro motor; the wind blade is mounted on a main shaft of the micro motor; the sleeve ring is mounted outside the micro motor and extends toward an outer ring of the wind blade; the outer ring of the wind blade is in a clearance fit with an inner wall of the sleeve ring; and the sleeve ring of the wind energy generator is inserted in the inner ring of the shock-absorbing sleeve.

8. The electric hair dryer according to claim 7, wherein the rib assembly comprises two first arc ribs disposed separately and two second arc ribs positioned between the two first arc ribs; an annular clamping groove is provided on an outer edge of one end of the shock-absorbing sleeve; a groove depth of the annular clamping groove is adapted to the first arc rib; and one end of the shock-absorbing sleeve is inserted in one of the two first arc ribs, and the other end of the shock-absorbing sleeve abuts against an end surface of the other of the two first arc ribs.

9. The electric hair dryer according to claim 8, wherein the heating device is positioned at a rear side of the air outlet of the wind energy generator; in this area, a heat insulation cover is provided inside the housing; the diversion structure is disposed on the heat insulation cover; an annular recess is provided on one side of the heat insulation cover at the wind energy generator; an inner flanging is provided on one side of an end surface of the shock-absorbing sleeve abutting against the first arc rib; and the first arc rib and the inner flanging abut against an inner side of the annular recess, and a hook portion formed by one groove sidewall of the annular recess is inserted in the inner flanging of the shock-absorbing sleeve to realize a sealing connection.

10. The electric hair dryer according to claim 9, wherein the heat insulation cover comprises a first cover body and a second cover body separately disposed; the diversion structure comprises a diversion opening disposed on the first cover body and in communication with the air outlet; the diversion opening is adjacent to the air outlet; a plurality of diversion plates are provided in an inner wall of the diversion opening along the circumferential direction; the diversion plates extend along a radial direction and are in an equidistant distribution along the circumferential direction; a vacancy position is provided on a tail end of the diversion opening; a cylindrical protrusion is provided in the second cover body; edges of the cylindrical protrusion and the second cover body are in an arc transition, and form a flow path; a splitter plate is provided in the second cover body at a position corresponding to the vacancy position of first cover body; the splitter plate divides the flow path of the second cover body into two independent portions; and a bottom of the splitter plate in the flow path of the second cover body extends to the vacancy position of the first cover body.

11. The electric hair dryer according to claim 10, wherein the first cover body is gradually recessed in a direction from the heating device to the diversion opening.

12. An electric hair dryer, comprising a housing, a wind energy generator, a drive control device, and a heating device, wherein an elongated channel is formed inside the housing, an air inlet is formed in the housing at one end of the elongated channel, and an air outlet is formed on the other end of the elongated channel; the wind energy generator and the heating device are disposed in the elongated channel, and the heating device is used for heating air flow in the elongated channel; and the drive control device is electrically connected to the wind energy generator and the heating device, wherein the heating device comprises a bearing plate forming a rectangular frame, a supporting frame positioned inside the rectangular frame, and a heating wire provided in the supporting frame; the supporting frame comprises supporting plates crossly overlapped with each other and a warm air channel formed by a gap between the supporting plates; a plurality of grooves are provided in an outer ring of the supporting plate; the heating wire is inserted in the groove and positioned in the warm air channel; a positive terminal and a negative terminal are provided in the supporting frame, which are corresponding to two ends of the heating wire respectively; and the positive terminal and negative terminal are electrically connected to the drive control device through conductive wire, and a fuse is provided in a connection section of one of the positive terminal or negative terminal.

* * * * *